United States Patent [19]

Martin

[11] Patent Number: 4,570,931

[45] Date of Patent: Feb. 18, 1986

[54] BASKETBALL

[75] Inventor: Robin A. Martin, Park Ridge, Ill.

[73] Assignee: Wilson Sporting Goods Co., River Grove, Ill.

[21] Appl. No.: 596,423

[22] Filed: Apr. 3, 1984

[51] Int. Cl.[4] ..... A63B 41/08

[52] U.S. Cl. ..... 273/65 EG; 40/327

[58] Field of Search ..... 273/65 EG, 232, 65 E, 273/65 ED, 65 EE, 65 EF; D21/204, 205; 40/327

[56] References Cited

U.S. PATENT DOCUMENTS 4,318,544 3/1982 Brine ..... 273/65 EG

FOREIGN PATENT DOCUMENTS 600722 6/1960 Canada ..... 273/65 EG 377354 7/1932 United Kingdom ..... 273/232

*Primary Examiner*—George J. Marlo

[57] ABSTRACT

The surface of a basketball is provided with rows of pebbles or projections, each of which has a flat triangular outer surface and three pointed apexes. The triangles in each row are arranged in alternating directions so that the fingers of a player will engage the pointed apexes of some triangles regardless of the direction in which the fingers extend.

9 Claims, 9 Drawing Figures

SECTION A-A

BASKETBALL

BACKGROUND AND SUMMARY

This invention relates to basketballs, and, more particularly, to a pebble design for the surface of a basketball.

The surface of a basketball is usually provided with a pebble design which increases the ability of a player to grip the ball. A conventional pebble design consists of rounded dimples which project upwardly from the spherical surface of the ball.

I have found that the ability of a player to grip a basketball can be substantially increased by forming the pebbles in the shape of polygonal projections, specifically, triangular projections. Each triangular projection includes a flat triangular outer surface and three pointed apexes. The triangular projections are arranged in rows, and the points of adjacent triangles in each row extend in different directions so that a player's hands will engage the points of some triangles regardless of the direction in which the hand extends in relationship to the ball. The points dig into the fingers as the player squeezes the ball and resist slipping movement of the fingers over the surface of the ball.

DESCRIPTION OF THE DRAWING

The invention will be explained in conjunction with an illustrative embodiment shown in the accompanying drawing, in which.

DESCRIPTION OF SPECIFIC EMBODIMENTS

A basketball 10 has an outer spherical surface 11 (FIG. 2) and pebbles or projections 12 which extend outwardly from the spherical surface. The surface of the basketball illustrated in FIG. 1 includes conventional smooth seams 13, 14, and 15, and the pebbled portions of the basketball lie in the areas between the seams.

Figure 1:
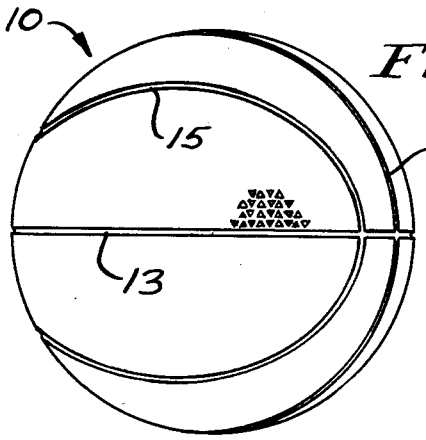
FIG. 1 illustrates a basketball which has a pebble design in accordance with the invention.
Figure 2:
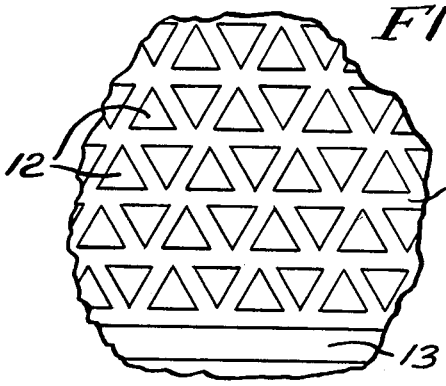
FIG. 2 is an enlarged fragmentary view of a portion of the ball of FIG. 1.
Figure 4:
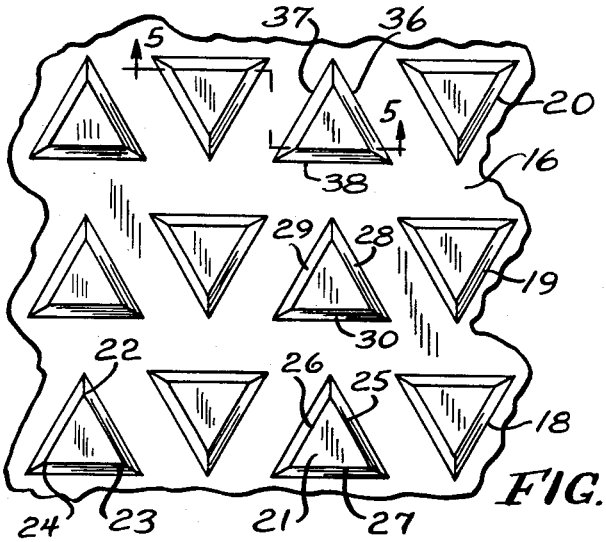
FIG. 4 is an enlarged fragmentary view of a portion of FIG. 3.
Figure 3:
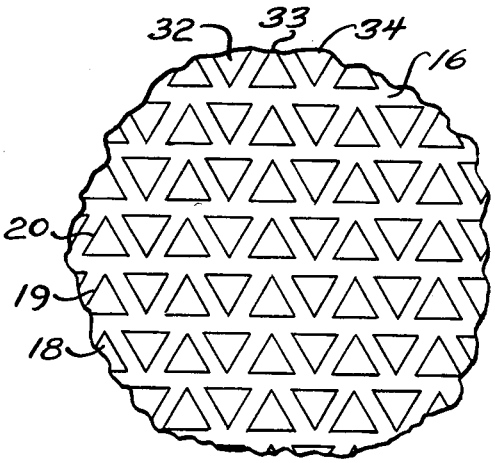
FIG. 3 is a fragmentary plan view of the pebble design of FIG. 1 projected on a flat surface.
Figure 5:
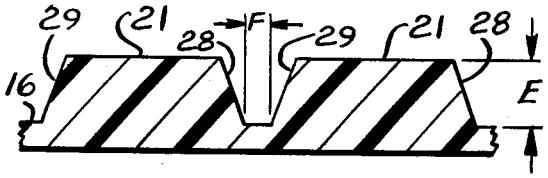
FIG. 5 is an enlarged sectional view taken along the line 5—5 of FIG. 4.

FIGS. 3–5 illustrate the pebble design of FIGS. 1 and 2 as it would appear if projected onto a flat surface 16. The pebbles 17 are arranged in parallel rows 18, 19, 20, etc. Each pebble includes an outer flat triangular surface 21 which includes three points or apexes 22, 23, and 24 and three straight sides 25, 26, and 27. Each triangular outer surface 21 extends parallel to the flat surface 16 and is spaced from the surface 16 by three inclined side walls 28, 29, and 30.

In each pair of adjacent triangles in each of the rows 18, 19, etc., one of the triangles has a point which lies adjacent the upper boundary of the row as viewed in FIG. 4, and one of the triangles has a straight side which is aligned with the upper boundary of the row. The triangles of each row are therefore arranged in alternating positions, one triangle pointing up as viewed in FIG. 4, and the next triangle pointing down.

The triangular surfaces in the embodiment illustrated are equilateral triangles, and the adjacent sides of adjacent triangles in each row extend parallel to each other. The upper and lower boundaries of each row are straight, parallel lines, and each triangle has a point and a straight side which lie on the upper and lower boundaries.

In the embodiment illustrated in FIGS. 3 and 4 each triangle of each row is aligned with triangles in the other rows so that the triangles are also arranged in columns 32, 33, 34 etc. (FIG. 3) which extend perpendicularly to the rows. The triangles in each column are arranged in the same orientation so that triangles in one row point up and the triangles in the adjacent rows point down.

When the flat pebble design of FIGS. 3–5 is formed on the spherical surface of a basketball as illustrated in FIG. 2, the rows of alternating upwardly and downwardly pointing triangles remain essentially aligned along latitudinal or longitudinal lines on the spherical surface. However, the columns are somewhat distorted or misaligned because of the spherical surface.

Figure 7:
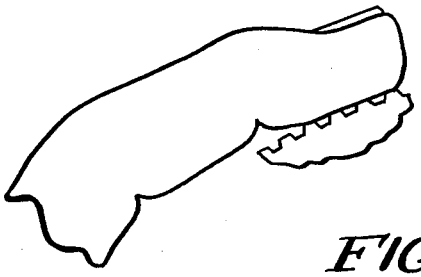
FIG. 7 illustrates a finger griping the triangular pebbles.

If the basketball surface illustrated in FIG. 2 were gripped by the fingers of a player, each finger would engage the points of several triangles regardless of the direction in which the fingers extended as shown in FIG. 7. These points would dig into the fingers as the player squeezed the ball, and relative sliding movement between the fingers and the ball would be restrained.

For example, if the fingers extended substantially vertically in FIG. 2 and exerted either an upward or downward sliding force, the triangles which point either upwardly or downwardly would engage the fingers. If the fingers extended at an angle of about 30° from either side of a vertical position, each finger would also directly engage the points of several triangles. Even if the fingers extended horizontally in FIG. 2, the fingers would still engage the points of the alternating triangles which point 30° from the vertical. The fingers would not engage the points along lines which bisect the points, but the points would still dig into the fingers. Regardless of the direction in which the fingers extend and exert a sliding force on the surface of the ball, the fingers are never angled more than 15° from lines which bisect a plurality of points.

Figure 6:
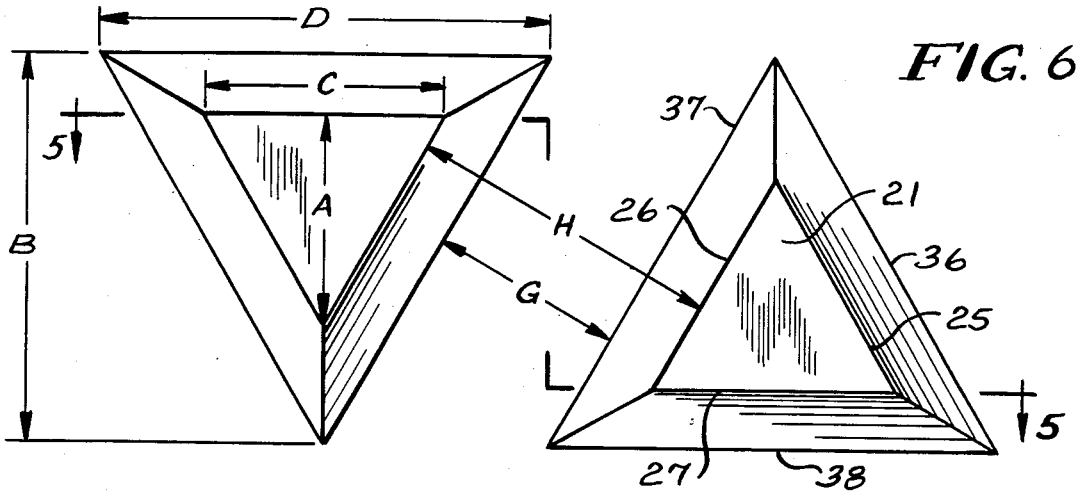
FIG. 6 is an enlarged fragmentary view of two of the triangles of FIG. 4.

Referring to FIGS. 5 and 6, in one specific embodiment of a pebble design using equilateral triangles, the height A of each of the flat triangular surfaces 21 was 0.088 inch, and the height B of each of the base triangles formed by the lines 36, 37, and 38 which define the merger of the side walls 28–30 and the flat surface 16 was 0.142. Each of the sides of each triangle 21 has a length C of 0.090, and each of the lines 36–38 had a length D of 0.140. The height E of the flat triangular surface 21 above the flat surface 16 was 0.050, and the inclined side walls 28–30 had a slope of 2:1. The dimension F (FIG. 5) between adjacent base triangles along the section line 5—5 (FIGS. 4 and 6) was 0.018. The perpendicular spacing G between adjacent base triangles was 0.074, and the perpendicular spacing H between adjacent triangles 21 was 0.108.

In another embodiment of a triangular pebble design, the dimensions A through H were:

A—0.088 inch
B—0.133 inch
C—0.105 inch
D—0.134 inch
E—0.045 inch
F—0.018 inch
G—0.065 inch
H—0.090 inch The inclined side walls 28–30 had a slope of 3:1.

Although the preferred embodiment of pebbles is a triangular shape, other polygons, for example, squares, pentagons, and hexagons, could also provide the benefits of the invention by presenting points which engage a player's fingers to restrain sliding movement of the fingers across the surface of the ball.

Figure 8:
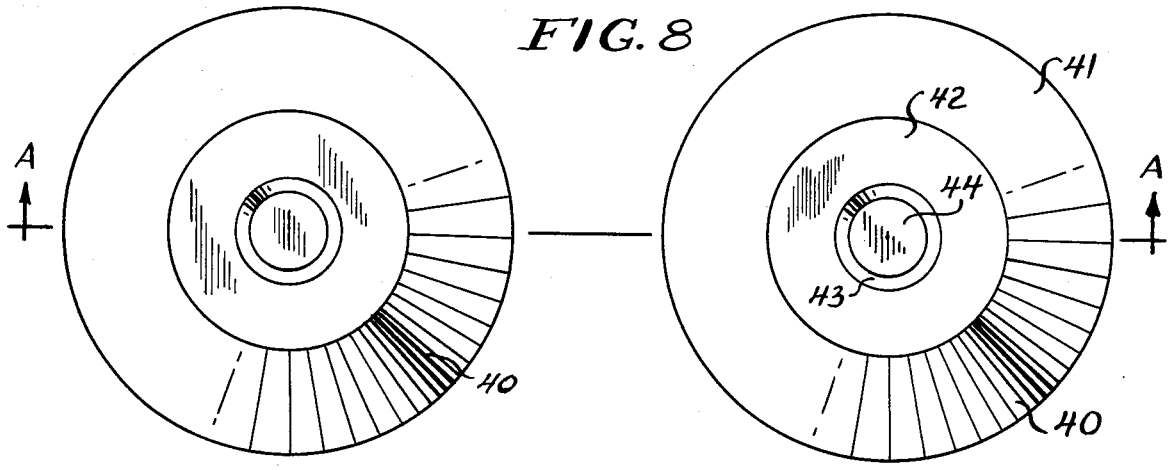
FIG. 8 is a top plan view of another embodiment of a pebble design.
Figure 9:
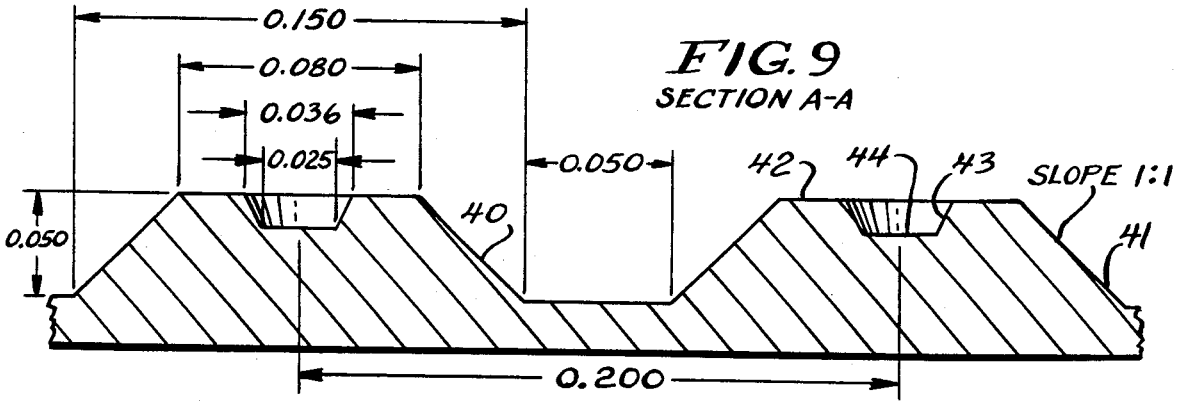
FIG. 9 is a sectional view taken along the line A—A of FIG. 8.

FIGS. 8 and 9 illustrate another embodiment of pebble design for a basketball. Each pebble 40 has the general shape of a volcano and includes an outer frusto-conical surface 41, a top flat annular surface 42, an inverted frusto-conical surface 43, and a flat circular depressed central surface 44. The dimensions of one specific embodiment of the volcano-type pebble with the inverse dimpled, truncated cone are shown in FIG. 9.

While in the foregoing specification, a detailed description of specific embodiments of the invention was set forth for the purpose of illustration, it will be understood that many of the details herein given may be varied considerably by those skilled in the art without departing from the spirit and scope of the invention.

I claim:

1. A basketball having a generally spherical surface with a plurality of triangular projections for increasing the ability of a player to grip the basketball, each of the triangular projections having a substantially flat triangular upper surface and three side walls which extend downwardly between the substantially flat upper surface of the projection and the spherical surface of the basketball, the triangular upper surface being defined by three straight sides which provide three pointed apexes.

2. The basketball of claim 1 in which the triangular projections are arranged in a plurality of spherical rows having an upper boundary and a lower boundary which extend generally parallel to each other, each pair of adjacent projections in each row being positioned so that one of the sides of one of the pairs of projections is generally aigned with the upper boundary of the row and one of the sides of the other of the pair of projections is generally aligned with the lower boundary of the row.

3. The basketball of claim 1 in which each of the side walls is inclined at a slope of about 2:1.

4. The basketball of claim 1 in which each of the side walls is inclined at a slope of about 3:1.

5. The basketball of claim 1 in which the triangular upper surface of each of the projections is an equilateral triangle.

6. The basketball of claim 5 in which the length of each of the sides of each triangular upper surface is from 0.090 to 0.105 inch.

7. The basketball of claim 1 in which the triangular upper surface of each of the projections is from 0.045 to 0.050 inch above the spherical surface of the basketball.

8. The basketball of claim 1 in which the triangular projections are arranged in a plurality of spherical rows, adjacent projections in each row being positioned so that adjacent sides of the triangular projections extend parallel to each other.

9. The basketball of claim 8 in which the perpendicular spacing between the parallel adjacent sides of the flat upper surfaces of adjacent projections in a row is from 0.090 to 0.108 inch.

* * * * *

UNITED STATES PATENT AND TRADEMARK OFFICE

CERTIFICATE OF CORRECTION

PATENT NO. : 4,570,931

DATED : February 18, 1986

INVENTOR(S) : Robin A. Martin

It is certified that error appears in the above-identified patent and that said Letters Patent is hereby corrected as shown below:

Col. 4, line 11 change "aigned" to --aligned--.

Signed and Sealed this

*Thirteenth* Day of *May 1986*

[SEAL]

*Attest:*

DONALD J. QUIGG

*Attesting Officer*

*Commissioner of Patents and Trademarks*